United States Patent [19]

Takagi et al.

[11] Patent Number: 4,795,309

[45] Date of Patent: Jan. 3, 1989

[54] TURBINE HOUSING FOR TURBOCHARGER

[75] Inventors: Kinshi Takagi, Tokyo; Nobuhiro Kondo, Chiba, both of Japan

[73] Assignee: Ishikawajima-Harima Jukogyo Kabushiki Kaisha, Tokyo, Japan

[21] Appl. No.: 130,551

[22] Filed: Dec. 9, 1987

[30] Foreign Application Priority Data

Dec. 16, 1986 [JP] Japan ..... 61-193251[U]

[51] Int. Cl.[4] ..... F01D 25/26

[52] U.S. Cl. ..... 415/138; 415/184; 415/205

[58] Field of Search ..... 415/134, 135, 136, 138, 415/183, 184, 185, 186, 203, 187, 204, 205, 219 C

[56] References Cited

U.S. PATENT DOCUMENTS

| | | | |
|---|---|---|---|
| 2,801,043 | 7/1957 | Spotz et al. | 415/205 X |
| 4,384,821 | 5/1983 | Mains et al. | 415/205 X |
| 4,389,845 | 6/1983 | Kolke | 415/205 X |
| 4,530,640 | 7/1985 | MacInnes | 415/205 X |
| 4,693,668 | 9/1987 | Kolke | 415/138 |

FOREIGN PATENT DOCUMENTS

| | | | |
|---|---|---|---|
| 3631130 | 3/1987 | Fed. Rep. of Germany | 415/138 |

*Primary Examiner*—Robert E. Garrett
*Assistant Examiner*—Joseph M. Pitko

[57] ABSTRACT

A turbine housing in which a gas passage is divided into a plurality of gas paths and which can prevent stress concentration and admixture of divided gas flows upon thermal deformation.

4 Claims, 3 Drawing Sheets

TURBINE HOUSING FOR TURBOCHARGER

BACKGROUND OF THE INVENTION

The present invention relates to a turbine housing for a turbocharger in which a gas passage is defined in a turbine wheel, chamber to introduce gas to a turbine wheel and more particularly a turbine housing for a turbocharger in which a gas passage is divided into a plurality of gas paths axially of the turbine.

Prevailing in conventional turbochargers is a concept of dividing a gas passage within a turbine housing into a plurality of gas paths so as to utilize dynamic energy as one means for improving turbocharger performance.

In some turbochargers of this type, a partition plate or plates for separating a gas passage into a plurality of gas paths are formed integral with a turbine housing. More particularly, as shown in FIGS. 1 and 2, a partition plate 2 is formed integral with a scroll-shaped inner surface of a turbine housing 1 so that a gas passage 3 is divided into gas paths 3*a* and 3*b* axially of a turbine. Reference numeral 4 represents a turbine wheel.

Such turbochargers with the integral turbine housing 1 and partition plate 2 are defective in that an inner periphery of the partition plate 2 may easily crack as shown in FIG. 1 when the plate 2 is thermally affected by a turbine wheel being operated. Because, the partition plate 2 formed integral with the turbine housing 1 cannot be thermally deformed and thermal stresses are concentrated at the partition plate 2.

In order to solve this problem, there has been proposed a construction in which a turbine housing is divided into segments and a partition plate independent of the turbine housing is partially floatably fitted between the segments. The independent partition plate is prevented from cracking when being subject to high temperatures since it can thermally deform in radial and circumferential directions. However, the circumferential deformation of the partition plate may cause at least an end face of the partition plate at a gas inlet 1' of the turbine housing to be displaced with the disadvantageous result that gases to flowing through the respective gas paths may be mixed.

In view of the above, a primary object of the present invention is to provide a turbine housing for a turbocharger in which a partition-plate receiving member is provided at a gas inlet for avoidance of admixture of gas flows and for prevention of concentration of thermal stresses.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
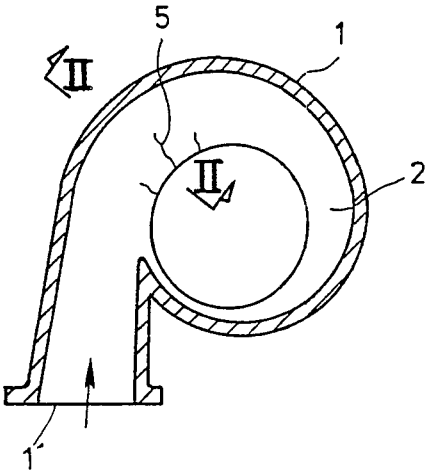
Fig.1 PRIOR ART
FIG. 1 is a cross-sectional view of a conventional turbine housing for a turbocharger.
Figure 2:
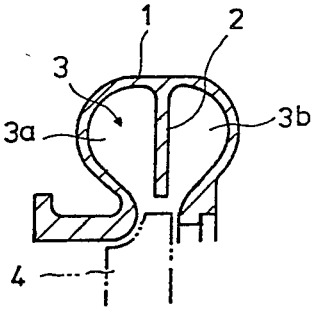
Fig.2 PRIOR ART
FIG. 2 is a sectional view, an enlarged scale, taken along the line II—II in FIG. 1.
Figure 3:
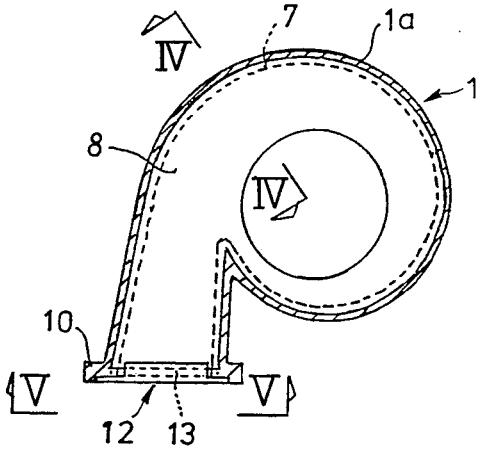
FIG. 3 is a cross-sectional view of a preferred embodiment of the present invention.
Figure 4:
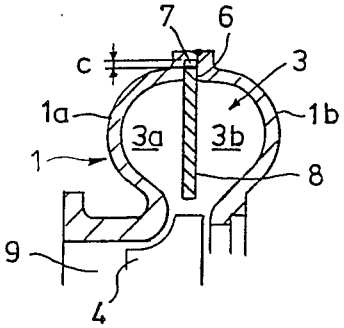
FIG. 4 is a sectional view, on an enlarged scale, taken along the line IV—IV in FIG. 3.
Figure 5:
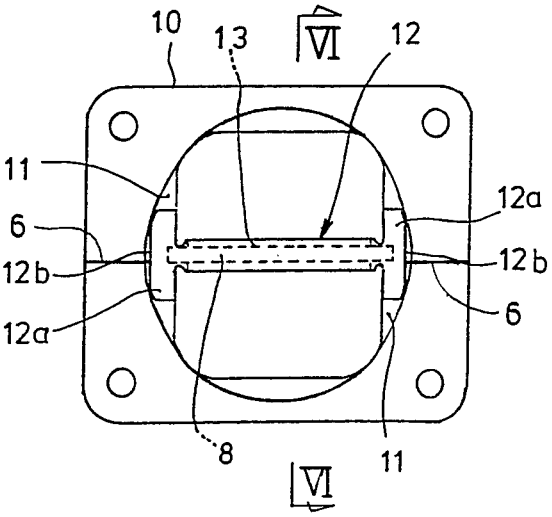
FIG. 5 is an end view, on an enlarged scale, taken along the line V—V in FIG. 5.
Figure 6:
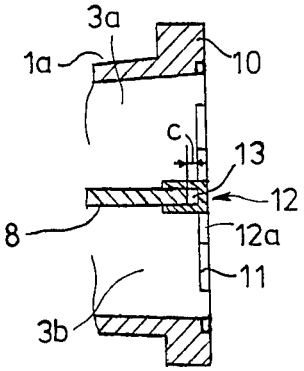
FIG. 6 is a sectional view, on an enlarged scale, taken along the line VI—VI in FIG. 5.

As shown in FIGS. 3–6, a turbine housing 1 is divided into housing segments 1*a* and 1*b* axially of the housing 1. A first groove 7 at an abutment 6 between the segments 1*a* and 1*b* extends from a gas inlet to the entire inner surface of a scroll. A partition plate 8 for dividing a gas passage 3 into gas paths 3*a* and 3*b* is annular and independent of the turbine housing 1. The annular partition plate 8 is snuggly fitted at its outer periphery into the groove 7 such that a clearance c is defined between the outer periphery of the plate 8 and a bottom of the groove 7. Outer peripheries of the segments 1*a* and 1*b* are securely joined at the abutment 6 to each other by welding or the like so that the gas passage 3 in communication with a turbine wheel chamber 9 is divided into the gas paths 3*a* and 3*b*.

The segments 1*a* and 1*b* are flanged at 10 for connection with a gas supply pipe and define thereat the gas inlet through which gases are supplied via the gas paths 3*a* and 3*b* to the turbine wheel chamber 9 accommodating the turbine wheel 4. The flanges 10 have recesses to define together arcuate embedding portions 11 into each of which each end of a partition-plate receiving member 12 is fitted and which are symmetrically on the flanges 10 at positions corresponding to the abutment 6. The receiving member 12 has a length sufficient to cross the gas passage at the gas inlet and has horizontal extensions or lugs 12*a* at both ends thereof. The receiving member 12 has further a second groove 13 which is formed at its inner major surface. The extensions 12*a* at both ends of the receiving member 12 are air-tightly drive-fitted into the embedding portions 11 or securely joined thereto by welding so that the receiving member 12 is prevented from falling from the flanges 10. An end of the partition plate 8 at the gas inlet, which is floatable, is slidably fitted into the groove 13 on the receiving member 12 and a clearance c is defined between an end face of the partition plate 8 and a bottom of the groove 13.

The partition-plate receiving member 12 is embedded into the embedding portions 11 such that an outer major surface of the receiving member 12 is coplanar with the outer surface of the flanges 10, whereby even when the position of the end face of the partition plate 8 at the gas inlet is displaced, admixture of the gases flowing through the respective gas paths 3*a* and 3*b* can be prevented. Thus, the performance of the partition plate 8 can be ensured.

During the operation of the turbine, the partition plate 8 is thermally affected and tends to be thermally deformed. Since the partition plate 8 is independent of the turbine housing 1 as described above, its thermal deformations in the radial and circumferential directions within the groove 7 are permitted. As a result, concentration of thermal stresses can be avoided and no cracks are produced in the partition plate 8.

The thermal deformations of the partition plate 8 in the circumferential direction and thus displacement of the end face of the partition plate 8 at the gas inlet of the turbine housing 1 can be absorbed since the partition plate 8 is slidably fitted into the groove 13 on the receiving member 12 and can slide within the clearance c in the groove 13.

In the operation of the turbine, the partition-plate receiving member 12 is also subjected to high temperatures and tends to be thermally deformed. The thermal deformations of the receiving member 12 in its longitudinal direction can be absorbed since the receiving member 12 has the extensions 12*a* with notches 12*b* at both ends thereof. If the receiving member 12 had no extensions at both ends thereof and were drive-fitted into or joined by welding to the flange surface, stresses would be concentrated at the abutment 6 between the segments 1*a* and 1*b* due to thermal deformations of the partition-plate receiving member 12 so that cracks would be easily produced. According to the present invention, the partition-plate receiving member 12 can absorb thermal deformations as described above so that even when the partition-plate receiving member 12 is thermally deformed, cracking at the abutment 6 between the housing segments 1*a* and 1*b* can be prevented.

Figure 7:
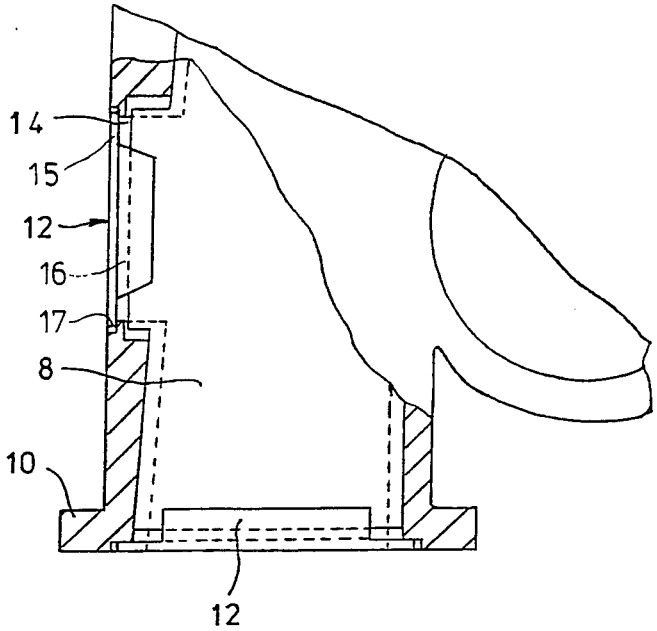
FIG. 7 is a partial sectional view of a further preferred embodiment of the present invention.

So far the partition-plate receiving member 12 has been described as being disposed at the gas inlet to the turbine wheel chamber, but it is to be understood that a partition-plate receiving member 12 may be also disposed as shown in FIG. 7 at a waste-gate gas outlet where the partiton plate 8 is partially floatable, so that admixture of gases flowing through the gas paths can be prevented and performance of the partition plate 8 can be ensured.

Figure 8:
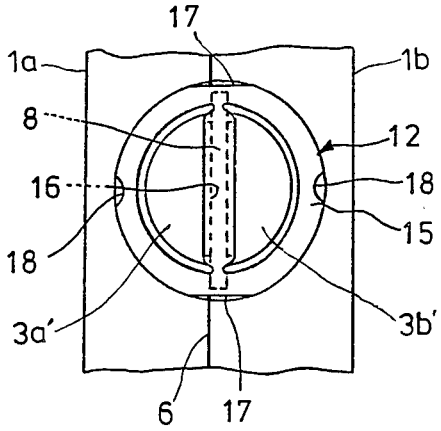
FIG. 8 shows a partition-plate mounting portion in the embodiment shown in FIG. 7.

The partiton-plate receiving member 12 is disposed at the waste-gate gas outlet 14 in a manner to be shown with reference to FIG. 8. The receiving member 12 comprises a ring shaped portion 15 conformed with the gas outlet 14 and a diametrical portion having a partition plate receiving groove 16 so as to section the gas paths 3*a* and 3*b* and provide substantially semi circular openings 3*a*' and 3*b*' for communication of the paths 3*a* and 3*b* with the exterior. Furthermore, the ring-shaped portion 15 has notches 17 formed at its outer periphery adjacent to the groove 16 so as to absorb thermal deformations. The partition-plate receiving member 12 is drive-fitted into a circular recess defined at a surface of the waste gate gas outlet 14 or the former is welded onto the latter at diametrically opposite notches 18 on the receiving member 12 so that the receiving member 12 can be prevented from falling off. Furthermore, a floating portion of the partition plate 8 is slidably fitted into the groove 16.

The partition-plate receiving member 12 of the type just described above permits thermal deformations so that the partition plate 8 is supported at the waste gate gas outlet 14 with no stress concentration, whereby the performance of the partition plate 8 can be ensured and admixture of gas flows can be prevented.

As described above, according to a turbine housing for a turbocharger in accordance with the present invention, one or more partition plates which divide a gas passage into a plurality of gas paths are independent of the turbine housing; the partition plate is fitted into a groove at an abutment of the turbine housing segments obtained by dividing the turbine housing in the axial direction so that thermal deformations of the partition plate may be absorbed; arcuate recesses or embedding portions are defined on the flanges at the gas inlet where the partiton plate is partially floating; the partition-plate receiving member which is embedded into the embedding portions is provided with extensions with notches at both ends thereof so as to permit thermal deformations; and a free end of the partition plate is slidably fitted into a groove on an inner surface of the receiving member. As a result, when the partition plate is subjected to high temperatures, it can freely thermally deform so that cracking is prevented. In spite of the thermal deformations of the partition plate, a partition-plate receiving member can prevent admixture of gases flowing through the gas paths at the gas inlet. The partition-plate receiving member is shaped such that any thermal deformations of the receiving member itself can be absorbed, so that no stress concentration occurs at the abutment of the housing segments and no cracks are produced at the abutment.

What is claimed is:

1. A turbine housing for a turbocharger comprising housing segments into which a turbine housing is divided in an axial direction and which define together a first groove along an inner periphery of an abutment therebetween; partition plate means independent of said turbine housing and fitted into said first groove such that a clearance is defined between a bottom of said first groove and an outer periphery of said partition plate; arcuate recess means on flanged surfaces of the housing segments at a gas inlet of the housing at a position corresponding to said abutment; and a partition-plate receiving member including lugs or extensions at opposite ends thereof, each with a notch leaving a space between the respective lug or extension and said arcuate recess means, to permit deformations of said receiving member while maintaining air-tight engagements thereof with said recess means for sectioning the gas inlet in correspondence with said partition plate means, said receiving member having a second groove formed at one major surface thereof to receive an end face of said partition plate means such that a clearance is defined between said end face of the partition plate means and a bottom of said second groove, said receiving member further having another major surface coplanar with said flanged surfaces of the housing segments.

2. The turbine housing according to claim 1 wherein said partition-plate receiving member is in the form of an I with said lugs or extensions.

3. The turbine housing according to claim 1 wherein a further partiton-plate receiving member substantially similar to the first mentioned partition-plate receiving member is disposed at a waste gate gas outlet of said turbine housing.

4. The turbine housing according to claim 3 wherein said further partition-plate receiving member comprises a ring-shaped portion having notches and a diametrical portion having a groove, said ring shaped portion being fitted into a circular recess at said waste gate gas outlet.

* * * * *